United States Patent [19]

Jansen

[11] 3,993,274

[45] Nov. 23, 1976

[54] BABY BOTTLE HOLDER

[76] Inventor: Mary Jo Jansen, 1513 Chalgrove Drive, Corona, Calif. 91720

[22] Filed: Aug. 27, 1975

[21] Appl. No.: 608,151

[52] U.S. Cl. ..... 248/107; 248/140

[51] Int. Cl.[2] ..... A47D 15/00

[58] Field of Search ..... 248/102–107, 248/130, 133, 137, 139–142, 115, 291, 292, 302

[56] References Cited

UNITED STATES PATENTS

| | | | |
|---|---|---|---|
| 273,098 | 2/1883 | Joslin | 248/142 |
| 932,344 | 8/1909 | Starbard | 248/107 |
| 1,569,585 | 1/1926 | Shover | 248/141 |
| 2,165,567 | 7/1939 | Moffat | 248/140 |
| 2,412,426 | 12/1946 | Rayko | 248/105 |
| 2,505,723 | 4/1950 | Rees | 248/142 |
| 2,619,951 | 12/1952 | Kahn | 248/137 |
| 2,648,513 | 8/1953 | Groff | 248/107 |
| 2,881,999 | 4/1959 | Mitchell | 248/106 |
| 3,000,601 | 9/1961 | Pedro | 248/106 |
| 3,028,133 | 4/1962 | Craig | 248/106 |

FOREIGN PATENTS OR APPLICATIONS

| | | | |
|---|---|---|---|
| 11,591 | 5/1907 | United Kingdom | 248/142 |

*Primary Examiner*—Lawrence J. Staab
*Attorney, Agent, or Firm*—Christie, Parker & Hale

[57] ABSTRACT

A bottle holding frame for infants includes a pair of spaced apart support frames of generally inverted U-shape, and a rotatable bridge member extending transversely between the tops of the support frames. A bottle holder carried on the bridge member clamps around a bottle to hold it in a downwardly tilted position for a baby placed under the bottle holding frame. A stop arm at one end of the bridge member rotates with the bridge member and can be positioned so it either holds the bottle in a fixed tilted position, or it allows the bottle to rotate freely, so that when the baby releases the bottle, it rotates to a position which prevents the bottle contents from dripping on the baby.

9 Claims, 4 Drawing Figures

BABY BOTTLE HOLDER

BACKGROUND

This invention relates to an improved holder for baby bottles, and more particularly to the type of holder which supports the bottle in a tilted position for a baby drinking from the bottle while lying on his back.

The present invention provides an improvement over known prior art devices for holding baby bottles, such as those disclosed in the following patents:

| U.S. Patent No. | Inventor |
|---|---|
| 2,881,999 | H. Mitchell |
| 3,000,601 | C. R. Pedro |
| 3,184,193 | E. W. Melvin |
| 3,222,020 | H. K. Rea |

The bottle holders disclosed in the patents to Rea, Pedro, and Melvin hold a baby bottle in a fixed, downwardly tilted position. These bottle holders work well for very small infants who drink from a bottle in which the nipple hole is usually so small that milk is not allowed to drip. For larger infants the nipple hole is typically larger to increase the flow. For these babies, a bottle held in a fixed downwardly tilted position will cause milk to drip onto the baby when he turns his head, or otherwise stops drinking from the bottle.

The patent to Pedro attempts to solve this problem by an extremely complicated mechanism which requires the baby's guardian to manually raise the bottle to a vertical nipple-up position each time the baby stops drinking from the bottle. The bottle holder still allows milk to drip onto the baby after he stops using the bottle, or turns his head, before the guardian has a chance to move the bottle to its vertical position.

The patent to Mitchell discloses a bottle holder which includes a spring-biased swivel for automatically rotating the bottle to a nipple-up position to prevent leakage after the baby releases the bottle. The Mitchell bottle holder works well for infants who are able to manipulate the bottle, but it does not accommodate the smaller infant for whom leakage is not a problem, and for whom the bottle should always be held in a fixed tilted position.

SUMMARY

The present invention provides an adjustable bottle holder for either holding a bottle in a stationary downwardly tilted position, or allowing the bottle to rotate automatically to a position which prevents leakage when a baby releases the bottle.

Briefly, the bottle holder includes a pair of spaced apart support members for holding the opposite ends of a rotatable bottle-supporting bridge member. A bottle holder carried by the bridge member holds a bottle in a tilted position so that a baby lying in a prone position can drink from the bottle. The opposite ends of the bridge member are rotatably attached to the support members so the bridge member can rotate about its axis. A rotatable stop device attached to the bridge member is movable between a first position, for holding the bottle in a stationary tilted position, and a second position, for allowing the bridge member to rotate freely so the bottle can either be held by the baby in its tilted position, or allowed to automatically rotate to a position preventing leakage from the bottle when the baby releases the bottle.

Thus, the bottle holder can be set in a stationary position for small infants, of say zero to four months in age, for whom the hole in the nipple is typically so small that liquid will not drip from it. When the bottle is held in its stationary tilted position, the nipple will not leak if the baby turns his head away from the bottle, and the baby can easily turn his head back again and find the nipple to continue drinking.

When the baby is older, say four to eight months in age, and a larger hole in the nipple is used, which allows drippage when tilted, then the bottle holder can be set so the bottle is freely rotatable. The baby then can easily hold the bottle in its tilted position when drinking from the bottle. In this position, the stop device preferably releasably engages a portion of the bridge support frame to help the baby hold the bottle in the desired tilted position. If the baby releases the bottle, then the bottle automatically rotates to at least a level position which substantially prevents leakage. At this age the baby can easily rock the bottle back again to its tilted position to resume drinking from the bottle.

These and other aspects of the invention will be more fully understood by referring to the following detailed description and the accompanying drawings.

DRAWINGS

DETAILED DESCRIPTION

Figure 1:
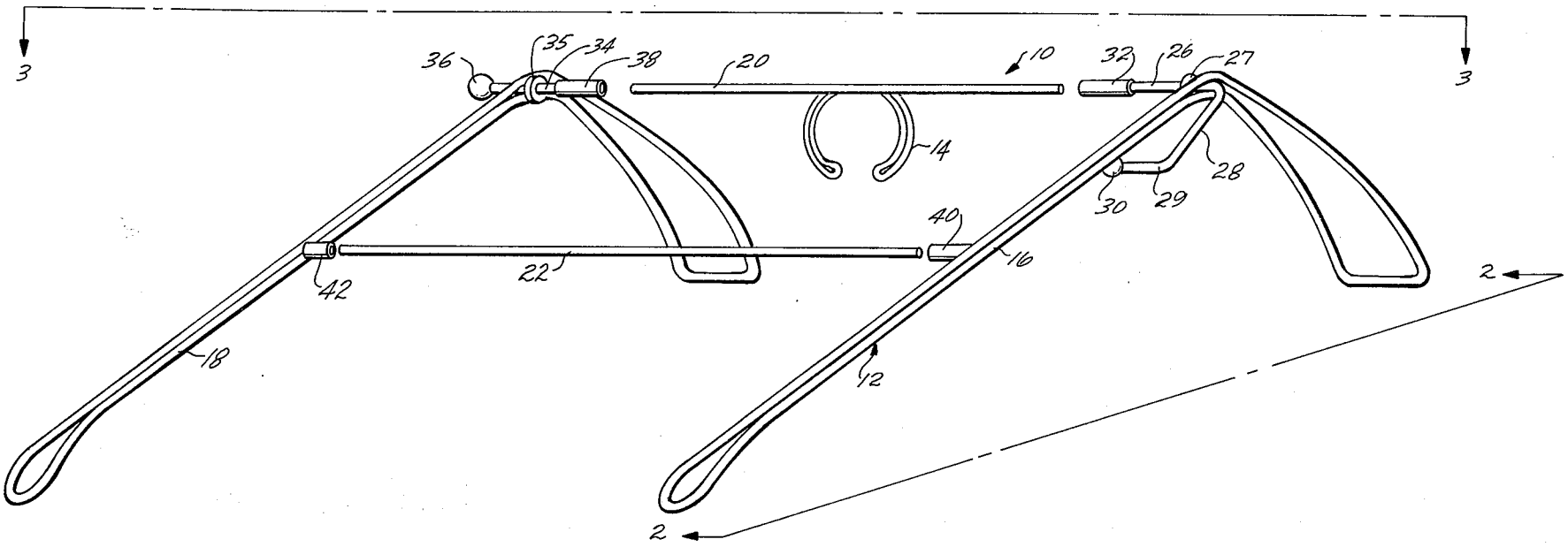
FIG. 1 is an exploded perspective view showing a baby bottle holder according to this invention.

Referring to the drawings, a bottle holding device 10 according to this invention includes a skeleton frame 12 for supporting a baby bottle holder 14. The frame is of the type which rests on a supporting surface and holds a bottle for a baby lying in a prone position under the frame. The frame 12 can be disassembled so the entire structure can fit into a relatively small space, or be easily transported. The frame 12 includes a pair of spaced apart and generally inverted U-shaped right and left bridge supports 16 and 18, respectively, an elongated transverse bridge member 20 for supporting the bottle holder 14, and an elongated transverse brace member 22.

Preferably, the bridge supports 16 and 18, the bridge member 20, and the bracing member 22 are made of spring steel rod or aluminum rod, which makes the entire structure resilient and relatively light in weight. The right and left bridge supports 16 and 18 can be arched more or less depending upon the height of the baby's shoulders and chest so that a baby bottle held in the bottle holder 14 will always have the nipple held in a comfortable position for the baby. The light weight of the structural members also makes the baby bottle holder easy to transport when disassembled. Preferably, all metal frame members are plastic or rubber-coated to prevent corrosion and provide a somewhat resilient exterior surface.

As shown best in FIG. 1, the right and left bridge supports 16 and 18 are each made from a single continuous piece of metal rod which is bend back at its ends to form blunt loops at the ends of each support. During use, the looped ends of the bridge supports rest on the desired supporting surface 24 (shown in FIG. 2). For the most part, the metal rod in each bridge support is shaped so that two lengths of rod extend side-by-side to form a double-thickness support which adds rigidity to the overall framework. These side-by-side sections of the rod can be rigidly held together, if desired, such as by spaced apart welds (not shown).

At the top of each bridge support the adjacent sections of rod are spread apart to provide openings for receiving rotatable right and left end supports for the opposite ends of the bottle-holding bridge member 20. In the right bridge support 16, the end support includes an elongated metal rod section 26 which extends through a loop or eye 27 rigidly attached to the top of the bridge support 16, say by welding. The eye 27 acts as a bearing for allowing the rod 26 to rotate about its axis. The rod is bent into a generally U-shaped and includes a downwardly extending leg 28 which terminates in a folded back stop bar 29 disposed below and extending generally parallel to section 26 of the end support. The end of the stop bar 29 includes an enlarged tip 30 made of rubber, plastic, or other similar resilient material to provide a safe blunt end. At the opposite end of the right end support, a sleeve 32 is attached to the rod 26, say by welding. The right end of the bridge member 20 can be slipped into the sleeve 32 and held in a tight friction fit when the bottle holding device is assembled.

In the left bridge support 18, the end support for the bridge member 20 includes an elongated rod 34 which extends through a loop or eye 35 at the top of the bridge support 18. The eye 35 acts as a bearing for allowing the rod 34 to rotate on its axis. The outer end of the rod 34 includes a resilient tip 36 of enlarged size similar to the tip 30. The inner end of the rod 34 carries an elongated sleeve 38 for receiving the left end of the bridge member 20 in a tight friction fit when the bottle holder is assembled.

An elongated sleeve 40 is rigidly affixed to the inside of the right bridge support 16, and a matching sleeve 42 is attached to the inside of the left bridge support 18. The two sleeves face one another to provide means for frictionally holding the opposite ends of the brace member 22 when the bottle holder is assembled.

Figure 3:
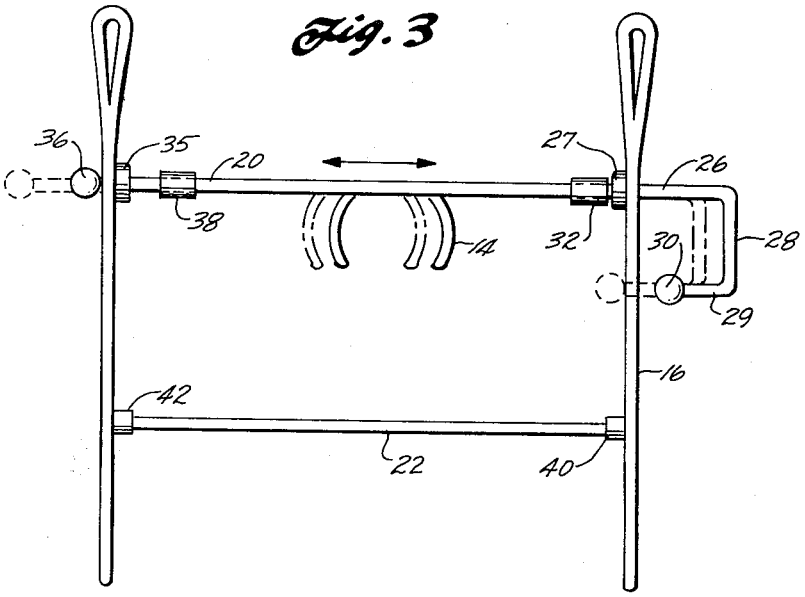
FIG. 3 is a plan view taken on line 3—3 of FIG. 1 and showing the assembled bottle holder.

In use, the bottle holding device 10 is assembled into a completed structure shown best in FIG. 3. The device is assembled by simply inserting the ends of the bridge member 20 into the sleeves 32 and 38, and inserting the ends of the brace member 22 into the sleeves 40 and 42.

A baby bottle 44 (shown in FIGS. 2 and 4) is then inserted into the U-shaped holder 14. Preferably, the holder 14 comprises a single piece of metal rod which is doubled back on itself to form the double-thickness clamp shown best in FIG. 1. The top of the clamp is preferably attached to the bridge member 20 by welding. However, in a separate embodiment (not shown) the rod which forms the bottle holder can be wrapped around the central portion of the bridge member 20 several times and then welded to the bridge member, if desired, to provide a more rigid means for attaching the bottle holder to the bridge member. Preferably, the bottle holder 14 comprises the equivalent of a pair of spaced apart resilient clamps which can be spread apart manually to receive the bottle. The clamps then return to their normal position and clamp around the bottle to hold it. The bottle holder 14 also can be made from materials other than spring metal wire rod, or can be in other forms, without departing from the scope of the invention.

The bottle holder of this invention is easily adjustable to suit the particular age and experience of the infant using it. For example, small infants, in the range of say zero to four months old, generally use a bottle in which the nipple hole is very small. In this instance, the bottle generally does not drip when left in a generally upright position with the nipple pointed downward. For older infants, in the range of say 4 to 8 months old, the nipple hole is typically larger, and the nipple will leak if the bottle is left with the nipple pointed downward. Moreover, smaller infants are not able to manipulate their bottles manually, but older infants, of say four to eight months, can manipulate their bottles. The present invention takes these factors into account by providing a bottle holder with a simple means of adjustment for holding the bottle either in a stationary tilted position, or for allowing the bottle to automatically rotate from its tilted position to a level position each time the infant's hold on the bottle is released.

Figure 2:
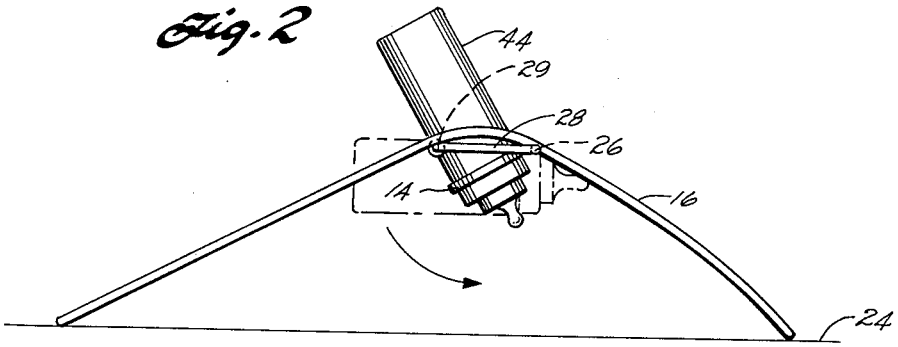
FIG. 2 is a side elevation view taken on line 2—2 of FIG. 1 and showing the baby bottle holder in a position for allowing the bottle to freely rotate to a level position when not in use.

In using the bottle holding device 10, the component parts shown in FIG. 1 are initially assembled into the structure shown best in FIG. 3, as described above. Referring to FIG. 2, the bridge member 20 is inserted in the right sleeve 32 so that when the bottle holder 14 is in the correct downwardly tilted position, the stop arm 29 will engage the underside of the right bridge support 16. The completed frame is then placed over the baby and the bottle is placed in the bottle holder 14 so it will be accessible to the baby while he is lying on his back.

Figure 4:
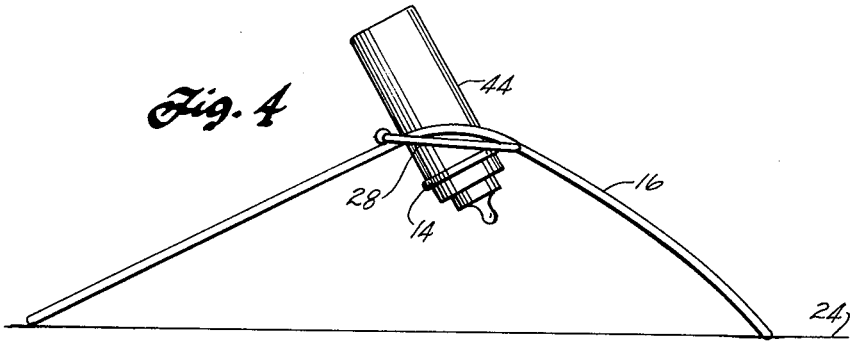
FIG. 4 is a side elevation view similar to that of FIG. 2 and showing the baby bottle holder held in a stationary position.

When using the bottle holder for smaller infants, of say zero to four months old, who are not generally capable of manipulating the bottle manually, then the bottle holder can be used in the form shown in FIG. 4. In this form, the bridge member 20 is moved lengthwise, transversely to the bridge support members 16 and 18, to the position shown in solid lines in FIG. 3. The bridge member 20 is then rotated on its axis so the stop arm 29 can be moved above the top surface of the right bridge support 16. The bridge member 20 is then moved back to the left, as viewed in FIG. 3, so the stop arm 29 can rest on the top surface of the right bridge support 16, as illustrated in phantom lines in FIG. 3. In this position, the right bridge member 16 engages the stop arm and acts as a stop to prevent the otherwise normal tendency for the bridge member to automatically rotate the bottle to the level position shown in FIG. 2. In an alternate embodiment of the invention (not shown), a clamping device or the like can be attached to the underside of the bridge support frame, and the stop arm 29 releasably engaged with the clamping device to hold the bottle in its stationary tilted position.

Thus, for small infants, of say zero to four months in age, who are not yet able to manipulate the bottle on their own, the bottle holder keeps the bottle in a stationary position from which the infant can easily drink. Since the nipple used on a bottle for infants of this age generally has a relatively small hole, the contents of the bottle will not drip on the infant when the bottle is held in a stationary position with the nipple pointed down.

When the infant is older, and eventually is able to manipulate the bottle on his own, then the bottle holder can be used in the form shown in FIG. 2. In this form, the bridge member 20 freely rotates about its axis, and when the bottle is held in the desired tilted position, the stop arm 29 releasably engages the underside of the right bridge member 16. The infant can manually rotate the bottle to the correct tilted position where the stop arm 29 engages the bridge support and assists the infant in holding the bottle in the correct position. When the infant stops drinking and releases the bottle, the bottle will automatically swivel to the level position, shown in phantom lines in FIG. 2, to prevent the nipple from leaking.

Thus, the bottle holder provides a convenient means of assistance for the infant who is able to manipulate his bottle. Moreover, the bottle will not drip on the infant each time he releases his hold on the bottle.

In conclusion, the invention provides a simple, yet convenient means for assisting infants of a wide range of ages and experience in drinking from their bottles. The bottle holder also has other advantages. For example, the entire frame is resilient so it can be adjusted to the baby's proportions. The bottle holder also is easy to transport because it is relatively light in weight, and can be easily disassembled into a relatively small size for carrying. Moreover, the bottle holder is very simple in construction, and therefore has advantages in terms of low cost when compared with the more complicated bottle holders of the prior art.

I claim:

1. A device for holding a baby bottle having a nipple in a position for feeding a baby, the device comprising:

a pair of spaced apart bridge supports for extending above the ground, the bridge supports having an upper surface and an undersurface;

an elongated bridge member extending transversely between the bridge supports, the bridge member having opposite end portions thereof attached to the bridge supports to hold the bridge member above the ground;

means on the supported bridge member for holding a bottle in a desired nipple-down position for feeding a baby lying in a prone position under the bridge member;

means for rotatably attaching the opposite end portions of the bridge member to the bridge supports to allow the bridge member to rotate about its axis, rotation of the bridge member normally causing the bottle-holding means to rotate a bottle to a nipple-up position preventing leakage from the nipple of the bottle;

stop means attached to at least one end portion of the bridge member, the stop means being spaced from the axis of the bridge member and being rotatable relative to the bridge supports in response to rotation of the bridge member; and means for slidably attaching the opposite end portions of the bridge member to the bridge supports to allow the bridge member to slide laterally relative to the bridge supports, the stop means being rotatable, in response to rotation of the bridge member, into and out of contact with the underside of said one bridge support, the stop means being slidable transversely with the bridge member relative to said one bridge support to rotate the stop means to a position in which it rests on the upper surface of said one bridge support, the stop means in said rest position resisting rotation of the bridge member relative to the bridge supports and therefore holding the bottle in said nipple-down position;

the stop means being releasable from said engaged position to permit the bridge member to rotate on its axis between said nipple-up position and said nipple-down position.

2. Apparatus according to claim 1 in which the means for slidably and rotatably attaching the bridge member to the bridge supports comprises a separate loop on each bridge support, the end portions of the bridge member extending through the opposed loops so the bridge member is freely slidable relative to the loops and is rotatable about a transverse axis through the opposed loops.

3. Apparatus according to claim 2 in which the stop means comprises a leg extending away from the axis of the bridge member, and a stop arm extending transversely to the leg and in a direction which intersects said one bridge support, the bridge member being slidable to move the stop arm transversely relative to the bridge supports to allow the stop arm to be freely rotated to a position above the upper surface of said one bridge support, the bridge member being slidable back to a position in which rotation of the bridge member rotates the stop arm into engagement with the upper surface of said one bridge support.

4. Apparatus according to claim 2 including a pair of end supports slidably engaged in the opposed loops, the end supports having means for being releasably and frictionally attached to the opposite ends of the bridge member.

5. Apparatus according to claim 4 including an elongated rigid brace member for extending between the bridge supports, and including a separate sleeve rigidly attached to each bridge support at a point spaced from the loop on the corresponding bridge support, the two sleeves providing means for releasably and frictionally holding the opposite ends of the brace member between the bridge supports.

6. Apparatus according to claim 4 in which one of said end supports includes a leg extending away from the axis of the loop in which the end support is rotatably mounted, and a stop arm extending transversely to the leg and in a direction which intersects said one bridge support, the stop arm being rotatable into and out of contact with said one bridge support and being rotatable to a position above said one bridge support so the stop arm releasably rests on the upper surface of the bridge support to hold the bottle in its nipple-down position.

7. Apparatus according to claim 1 in which the stop means comprises a leg extending away from the axis of the bridge member, and a stop arm extending transversely to the leg and in a direction which intersects said one bridge support, the bridge member being slidable to move the stop arm transversely relative to the bridge supports to allow the stop arm to be freely rotated to a position above the upper surface of said one bridge support, the bridge member being slidably back to a position in which rotation of the bridge member rotates the stop arm into engagement with the upper surface of said one bridge support.

8. Apparatus according to claim 1 including means for releasably engaging the opposite ends of the bridge member with the bridge supports.

9. Apparatus according to claim 8 including an elongated rigid brace member for extending between the bridge supports, and means for releasably engaging the opposite ends of the brace member with the bridge supports at points thereon spaced longitudinally from the points of attachment of the bridge member.

* * * * *